United States Patent [19]

Penney et al.

[11] Patent Number: 4,640,258

[45] Date of Patent: Feb. 3, 1987

[54] ARCHERY SHOOTING BOW WITH STABILIZING FLASHLIGHT

[75] Inventors: C. Bradford Penney, Norristown; Raymond L. Sharrah, Collegeville, both of Pa.

[73] Assignee: Streamlight, Inc., Norristown, Pa.

[21] Appl. No.: 667,209

[22] Filed: Nov. 1, 1984

[51] Int. Cl.[4] ..... F41B 5/00

[52] U.S. Cl. ..... 124/24 R; 124/89; 362/109

[58] Field of Search ..... 124/23 R, 24 R, 88, 124/89; 362/102, 109, 110

[56] References Cited

U.S. PATENT DOCUMENTS

| | | | |
|---|---|---|---|
| 1,128,167 | 2/1915 | Manson | 362/102 |
| 3,288,988 | 11/1966 | Boggs | 124/23 R |
| 3,450,122 | 6/1969 | Diamond | 124/24 R |
| 3,589,350 | 6/1971 | Hoyt | 124/89 |
| 4,169,454 | 10/1979 | Jones | 124/89 |
| 4,296,725 | 10/1981 | Broderick | 124/88 |

FOREIGN PATENT DOCUMENTS

| | | | |
|---|---|---|---|
| 521449 | 10/1976 | U.S.S.R. | 362/102 |

OTHER PUBLICATIONS

Bow & Arrow Publication, Jun. 1982, p. 41.
Bow & Arrow Publication, Jun. 1985, p. 45.
Archery World, Aug./Sep. 1979, p. 24.

*Primary Examiner*—Richard C. Pinkham
*Assistant Examiner*—Benjamin Layno
*Attorney, Agent, or Firm*—Gene W. Arant; Paul H. Ware

[57] ABSTRACT

An archery shooting bow having an elongated cylindrical flashlight mounted thereupon and oriented so as to both provide forward illumination for the archer in the general direction in which an arrow may be shot from the bow and also so as to serve as a stabilizer for the bow.

2 Claims, 3 Drawing Figures

ARCHERY SHOOTING BOW WITH STABILIZING FLASHLIGHT

BACKGROUND OF THE INVENTION

1. Field of the Invention

This invention relates generally to archery bows used for shooting arrows and more particularly to those archery bows that provide stabilizing members in the form of projecting, elongated cylindrical members.

2. Description of the Prior Art

Archery bows for shooting arrows are available that incorporate stabilizing members in the form of elongated cylindrical members. No provision, however, has been made in prior art devices for target illumination by means, self-contained within the archery bow system. Further, no provision has been made in prior art archery bows to utilize a stabilizing member as a target illuminating device.

A great advantage would be realized through the provision of a member that combines the functions of bow stabilization with target illumination.

It would thus be a great advantage to the art to provide an archery bow that combines the functions of target illumination with archery bow stabilization.

SUMMARY OF THE INVENTION

The invention described herein accomplishes the dual functions of bow stabilization and target illumination through the artifice of mounting an elongated cylindrical flashlight in the place of the elongated cylindrical member erstwhile used exclusively for bow stabilization.

It is therefore a primary object of the present invention to provide a stabilizer for an archery bow that combines the function of target illumination with archery bow stabilization.

It is a further object of the present invention to provide such an archery bow by substituting an elongated cylindrical flashlight for the conventional elongated cylindrical stabilizing member.

Another object of the present invention is to provide as a bow stabilizing member an elongated, cylindrical flashlight that therefore additionally provides target illumination.

Thus an archery bow is provided that combines the functions of illumination and stabilization by mounting a flashlight in the position priorly occupied by a stabilizing member.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which.

DETAILED DESCRIPTION

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 1:
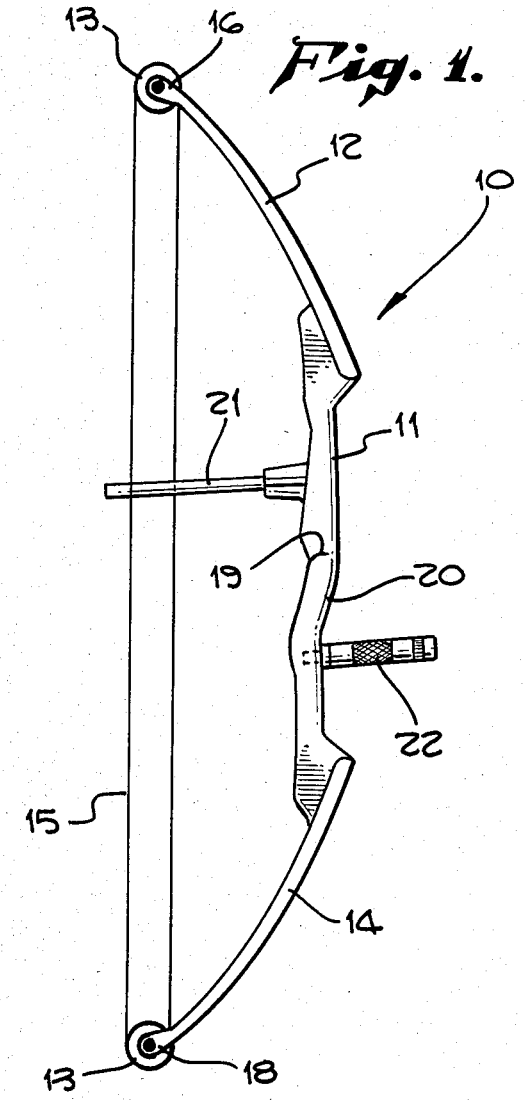
FIG. 1 is an idealized side elevation showing the illuminating flashlight in place as a stabilizer.

Referring to FIG. 1 with greater particularity, attention is drawn to the flashlight-stabilizer having an elongated metal housing 22 mounted on rigid central portion 11 just below the hand grip or handle 20 of the archery bow 10. The archery bow 10 has an upper limb or bendable end portion 12 ending in an upper tip or extremity 16 and a lower limb or bendable end portion 14 ending in a lower tip or extremity 18. String mechanisms 13 connect bow string 15 to archery bow 10 in conventional manner being held in alignment by means of alignment retaining member 21. The arrow guide is denoted by numeral 19. All parts of the archery bow 10 serve their conventional purposes except for the flashlight-stabilizer 22.

The flashlight here shown may, for example, be of the kind shown in the specification Ser. No. 650,116, filed Sept. 13, 1984, for ROTATING HEAD SWITCH MECHANISM FOR FLASHLIGHT now U.S. Pat. No. 4,581,686, inventor Norman C. Nelson and assigned to the same assignee, Streamlight, Inc., as the present invention. This flashlight is characterized by the fact that the head of the flashlight is rotated to turn the light on or off.

Figure 2:
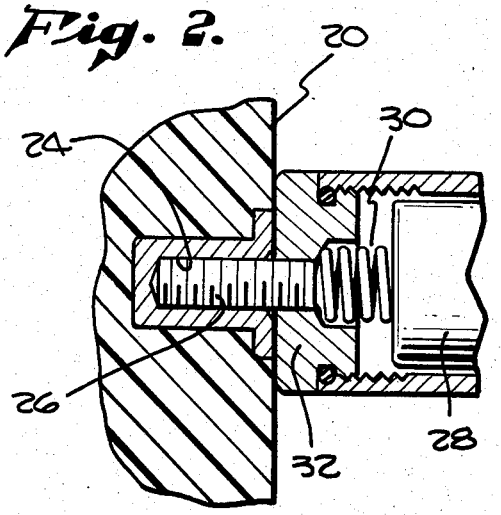
FIG. 2 is a partial cross sectional view showing a method of attachment by means of which the flashlight may be secured to the bow.

In FIG. 2, a means by which the flashlight-stabilizer 22 may be secured to the archery bow 10 is illustrated. Hand grip or handle 20 has a metal socket 24 provided within itself with a threaded or tapped bore facing away from said string mechanism 13 and said bow string 15. A threaded stud 26, secured to flashlight-stabilizer end cap or tail cap 32, provides threaded attachment to hand grip or handle 20 by being threadedly connected into threaded bore 24. The cutaway, cross sectional drawing of FIG. 2 also shows battery 28 being held under tension by means of battery tensioning spring 30.

Figure 3:
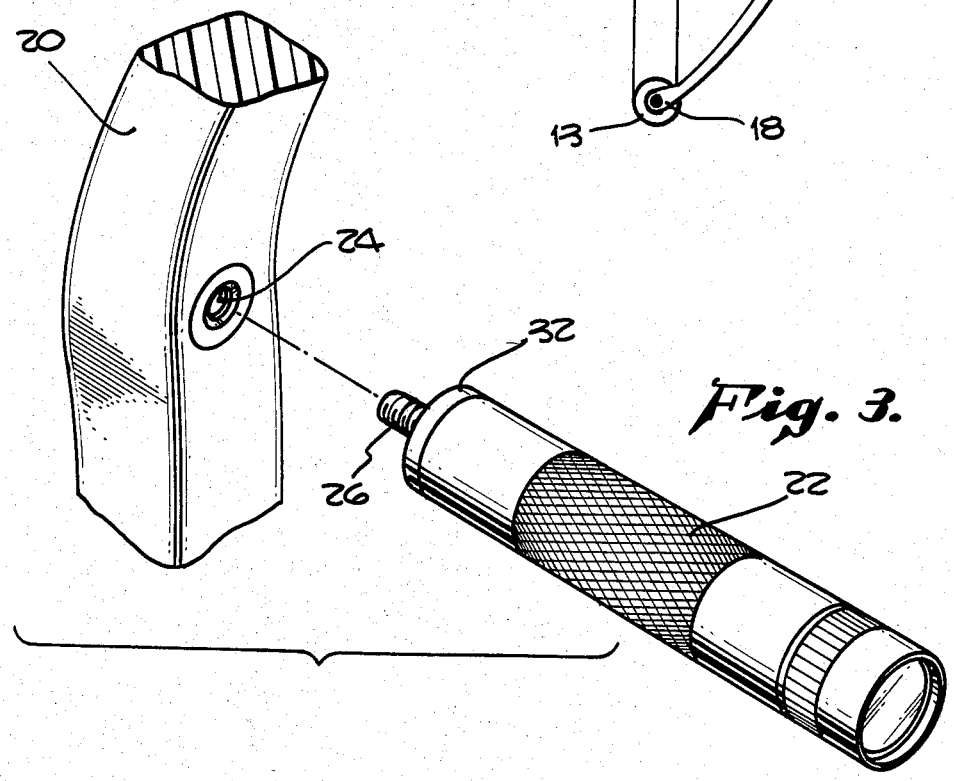
FIG. 3 is an idealized exploded perspective view of the method of attachment of FIG. 2.

FIG. 3 shows the flashlight-stabilizer 22 disconnected from hand grip or handle 20 but oriented such that connection and attachment can be made thereto by threading stud 26 into the bore of socket 24.

Thus, there has been described an archery shooting bow that has means for mounting an elongated cylindrical flashlight thereupon oriented in such a manner as to serve as a stabilizing member while at the same time, providing illumination in the direction of a target.

It is here pointed out that although the present invention has been shown and described with reference to a particular embodiment, nevertheless various changes and modifications, obvious to one skilled in the art to which the invention pertains, are deemed to lie within the purview of the invention.

What is claimed is:

1. A shooting bow assembly comprising:

a bow having an elongated frame with a rigid central portion and bendable end portions, a string mechanism intercoupling the extremities of said end portions, a hand grip formed on said rigid central portion of said frame, an arrow guide carried by said frame adjacent the upper end of said hand grip, and a tapped threaded bore in said rigid central portion of said frame adjacent the lower end of said hand grip, said bore facing away from said string mechanism;

a flashlight having an elongated metal housing and a metal tail cap on the rearward end of said housing, said tail cap having a protruding threaded stud which is threadedly secured within said threaded bore;

said flashlight having switch means that may be manually actuated while said flashlight is fixedly supported from said threaded bore; and said flashlight acting as a stabilizer for said bow and concurrently providing illumination in the general direction in which an arrow may be shot from said bow.

2. A shooting bow assembly comprising:

a bow having an elongated frame with a rigid central portion and bendable end portions, a string mechanism intercoupling the extremities of said end portions, a hand grip formed on said rigid central portion of said frame, an arrow guide carried by said frame adjacent the upper end of said hand grip, and a metal socket provided within said rigid central portion of said frame adjacent the lower end of said hand grip, said socket having a threaded bore aligned perpendicular to said central portion of said frame and facing away from said string mechanism;

a flashlight having an elongated metal housing and a metal tail cap on the rearward end of said housing, said tail cap having a protruding threaded stud which is threadedly secured within said threaded bore, said flashlight being provided with means adapting it to be turned on or off by rotation of its head; and said flashlight acting as a stabilizer for said bow and concurrently providing illumination in the general direction in which an arrow may be shot from said bow.

* * * * *